US009452761B2

(12) United States Patent
Romero

(10) Patent No.: US 9,452,761 B2
(45) Date of Patent: Sep. 27, 2016

(54) PLATFORM SCREEN GATE SYSTEM

(71) Applicant: Overhead Door Corporation, Lewisville, TX (US)

(72) Inventor: Federico Romero, Corpus Christi, TX (US)

(73) Assignee: Overhead Door Corporation, Lewisville, TX (US)

( * ) Notice: Subject to any disclaimer, the term of this patent is extended or adjusted under 35 U.S.C. 154(b) by 0 days.

(21) Appl. No.: 14/275,148

(22) Filed: May 12, 2014

(65) Prior Publication Data

US 2014/0331560 A1 Nov. 13, 2014

Related U.S. Application Data

(60) Provisional application No. 61/822,818, filed on May 13, 2013.

(51) Int. Cl.

| | |
|---|---|
| ***E05F 11/00*** | (2006.01) |
| ***B61B 1/02*** | (2006.01) |
| ***E05F 15/643*** | (2015.01) |
| *E05D 15/06* | (2006.01) |

(52) U.S. Cl.

CPC ..... *B61B 1/02* (2013.01); *E05F 15/643* (2015.01); *E05D 15/0617* (2013.01); *E05Y 2201/652* (2013.01); *E05Y 2600/312* (2013.01); *E05Y 2800/232* (2013.01); *E05Y 2900/404* (2013.01)

(58) Field of Classification Search

USPC ..... 49/49, 360, 323, 372, 404, 358; 105/341, 425

See application file for complete search history.

(56) References Cited

U.S. PATENT DOCUMENTS

| | | | | |
|---|---|---|---|---|
| 1,631,416 | A * | 6/1927 | Howard | 49/358 |
| 1,639,866 | A * | 8/1927 | Szuch et al. | 49/49 |
| 2,666,333 | A | 1/1954 | Geyer | |
| 3,403,474 | A | 10/1968 | Spasoff | |
| 3,477,670 | A * | 11/1969 | Sloyan | 248/653 |
| 3,775,906 | A * | 12/1973 | Dougherty | 49/358 |
| 3,863,390 | A | 2/1975 | Sawdai | |
| 3,981,203 | A | 9/1976 | Williams | |
| 4,000,582 | A | 1/1977 | Monot | |
| 4,030,160 | A | 6/1977 | Lambertz et al. | |
| 4,045,914 | A | 9/1977 | Catlett | |
| 4,091,570 | A | 5/1978 | Favrel | |

(Continued)

FOREIGN PATENT DOCUMENTS

| | | | | |
|---|---|---|---|---|
| DE | 4015448 A1 * | 11/1991 | | E05F 15/10 |
| GB | 2075564 A | 11/1981 | | |

(Continued)

OTHER PUBLICATIONS

PCT Search Report & Written Opinion for PCT/US2014/037681 dated Sep. 26, 2014 (12 pgs).

*Primary Examiner* — Jerry Redman

(74) *Attorney, Agent, or Firm* — Gardere Wynne Sewell LLP

(57) ABSTRACT

A platform screen gate system having a tower, a gate secured to the tower. The gate is movable between an open position, to facilitate access to and from the platform, and a closed position, to block access to and from the platform. The system further includes at least one roller secured to the tower and a track secured to the gate. The track is supported by and movable on the least one roller such that the door cantilevers from the tower and remains above the platform when the door is moved between the open and closed positions.

22 Claims, 4 Drawing Sheets

(56) References Cited

U.S. PATENT DOCUMENTS

| | | | | |
|---|---|---|---|---|
| 4,188,752 | A | 2/1980 | Monot | |
| 4,198,786 | A | 4/1980 | Monot | |
| 4,220,051 | A | 9/1980 | Catlett | |
| 4,240,226 | A | 12/1980 | Georgelin | |
| 4,305,227 | A | 12/1981 | Georgelin | |
| 4,394,607 | A | 7/1983 | Lemirande | |
| 4,541,202 | A | 9/1985 | Dockery | |
| 4,573,286 | A | 3/1986 | Favrel et al. | |
| 4,605,108 | A | 8/1986 | Monot | |
| 4,823,010 | A | 4/1989 | Kornbrekke et al. | |
| 4,865,576 | A * | 9/1989 | Hwang et al. | 474/114 |
| 4,893,435 | A | 1/1990 | Shalit | |
| 5,140,770 | A | 8/1992 | Morvan | |
| 5,142,152 | A | 8/1992 | Boiucaner | |
| 5,218,282 | A | 6/1993 | Duhame | |
| 5,233,724 | A | 8/1993 | Lei tert et al. | |
| 5,251,418 | A | 10/1993 | Jacobs et al. | |
| 5,349,783 | A | 9/1994 | Jasperson et al. | |
| 5,581,944 | A | 12/1996 | Kornbrekke et al. | |
| 5,598,606 | A | 2/1997 | Jacobs | |
| 5,634,298 | A | 6/1997 | Slopack | |
| 5,656,898 | A | 8/1997 | Kalina | |
| 5,673,516 | A | 10/1997 | Hughes et al. | |
| 5,711,112 | A | 1/1998 | Barten et al. | |
| 5,816,309 | A | 10/1998 | Paradise | |
| 5,830,046 | A * | 11/1998 | Dugger et al. | 451/297 |
| 5,845,579 | A | 12/1998 | Langley et al. | |
| 5,927,017 | A | 7/1999 | Jacobs et al. | |
| 5,992,094 | A | 11/1999 | Diaz | |
| 6,065,249 | A | 5/2000 | Gephart et al. | |
| 6,092,338 | A * | 7/2000 | Crowner et al. | 49/360 |
| 6,108,977 | A | 8/2000 | Payne et al. | |
| 6,176,292 | B1 | 1/2001 | Norton, II | |
| 6,198,242 | B1 | 3/2001 | Yokomori et al. | |
| 6,209,171 | B1 | 4/2001 | Pelletier et al. | |
| 6,360,668 | B1 | 3/2002 | Rauch | |
| 6,371,188 | B1 | 4/2002 | Baczuk et al. | |
| 6,401,629 | B1 | 6/2002 | Brunooghe | |
| 6,526,695 | B1 | 3/2003 | Nguyen | |
| 6,581,332 | B1 | 6/2003 | Kim | |
| 6,591,760 | B2 | 7/2003 | Brunooghe | |
| 6,679,186 | B2 | 1/2004 | Prevost | |
| 6,751,909 | B2 | 6/2004 | Ranaudo | |
| 6,786,006 | B2 | 9/2004 | Kowalczyk et al. | |
| 6,854,212 | B2 | 2/2005 | Engelgau et al. | |
| 6,918,210 | B1 | 7/2005 | Smiley | |
| 7,021,007 | B2 | 4/2006 | Jacobs | |
| 7,042,492 | B2 | 5/2006 | Spinelli | |
| 7,213,369 | B2 | 5/2007 | Freeman | |
| 7,328,662 | B2 | 2/2008 | Kasai et al. | |
| 7,449,856 | B2 | 11/2008 | Valencia et al. | |
| 7,530,199 | B2 | 5/2009 | Yokomori et al. | |
| 7,692,542 | B2 | 4/2010 | Outzs | |
| 7,707,775 | B2 | 5/2010 | Yokomori et al. | |
| 7,721,653 | B1 | 5/2010 | Burgess | |
| 7,783,369 | B2 | 8/2010 | Shoda et al. | |
| 7,802,521 | B2 | 9/2010 | Gunes | |
| D626,907 | S | 11/2010 | Bonneau | |
| 7,940,300 | B2 | 5/2011 | Spinelli | |
| 8,026,809 | B2 | 9/2011 | Schafer et al. | |
| 8,176,684 | B2 * | 5/2012 | Marchetto | 49/506 |
| 8,183,811 | B2 | 5/2012 | Tate | |
| 8,205,387 | B2 | 6/2012 | Ranaudo et al. | |
| 8,225,552 | B2 | 7/2012 | Yokomori et al. | |
| 8,297,201 | B2 | 10/2012 | Mercier et al. | |
| 8,358,198 | B2 | 1/2013 | Harper et al. | |
| 8,365,469 | B2 | 2/2013 | Kowalczyk et al. | |
| 8,387,541 | B2 | 3/2013 | Losito | |
| 8,405,337 | B2 | 3/2013 | Gebhart et al. | |
| 8,448,997 | B2 | 5/2013 | Laliberte et al. | |
| 8,464,470 | B2 | 6/2013 | Katagata et al. | |
| 8,707,627 | B2 * | 4/2014 | Murray et al. | 49/506 |
| 2002/0104266 | A1 | 8/2002 | Ranaudo | |
| 2004/0128925 | A1 | 7/2004 | Massey | |
| 2004/0159048 | A1 | 8/2004 | Jacobs | |
| 2004/0187387 | A1 | 9/2004 | Hedrich | |
| 2005/0000164 | A1 | 1/2005 | Jacobs | |
| 2006/0139453 | A1 | 6/2006 | Spinelli | |
| 2006/0191749 | A1 | 8/2006 | Sasaki et al. | |
| 2006/0248979 | A1 | 11/2006 | Gephart et al. | |
| 2008/0190031 | A1 | 8/2008 | Winkelmann et al. | |
| 2008/0236048 | A1 | 10/2008 | Kowalczyk et al. | |
| 2008/0250716 | A1 | 10/2008 | Ranaudo et al. | |
| 2009/0139147 | A1 | 6/2009 | Mercier et al. | |
| 2009/0284024 | A1 | 11/2009 | DeLeonardis et al. | |
| 2009/0307980 | A1 | 12/2009 | Hemmings | |
| 2010/0050530 | A1 | 3/2010 | Blasi | |
| 2010/0219016 | A1 * | 9/2010 | Meillet | 182/8 |
| 2010/0269415 | A1 * | 10/2010 | Busch | 49/358 |
| 2011/0173891 | A1 | 7/2011 | Laliberte et al. | |
| 2011/0214350 | A1 | 9/2011 | Salvietti et al. | |
| 2011/0225885 | A1 | 9/2011 | Van Tassell, III | |
| 2011/0245978 | A1 | 10/2011 | Farrell et al. | |
| 2012/0023827 | A1 | 2/2012 | Hancock et al. | |
| 2012/0031006 | A1 | 2/2012 | Katagata et al. | |
| 2012/0066976 | A1 * | 3/2012 | Murray et al. | 49/358 |
| 2012/0073205 | A1 | 3/2012 | Hamaker et al. | |
| 2012/0117881 | A1 | 5/2012 | Seymour et al. | |
| 2012/0120234 | A1 | 5/2012 | Fullalove et al. | |
| 2012/0144748 | A1 | 6/2012 | Ranaudo et al. | |
| 2012/0159851 | A1 | 6/2012 | Seymour et al. | |
| 2012/0192490 | A1 | 8/2012 | McCaslin | |
| 2012/0272576 | A1 | 11/2012 | Van Tassell, III et al. | |
| 2012/0297685 | A1 | 11/2012 | Kawamoto et al. | |
| 2013/0091771 | A1 | 4/2013 | Shekari oreh | |
| 2013/0318877 | A1 * | 12/2013 | Dalman | 49/358 |
| 2014/0223825 | A1 * | 8/2014 | Murray et al. | 49/29 |
| 2014/0259930 | A1 * | 9/2014 | Gilliam | 49/70 |
| 2016/0024833 | A1 * | 1/2016 | Miller | |

FOREIGN PATENT DOCUMENTS

| | | | |
|---|---|---|---|
| GB | 2418221 | A | 3/2006 |
| JP | H11287067 | A | 10/1999 |
| WO | WO-2011048391 | A1 | 4/2011 |

* cited by examiner

PLATFORM SCREEN GATE SYSTEM

CROSS-REFERENCE TO RELATED APPLICATIONS

This non-provisional application claims the benefit of U.S. Provisional Patent Application Ser. No. 61/822,818, filed May 13, 2013, the disclosure of which is hereby incorporated by reference in its entirety.

BACKGROUND

Platform screen gate systems are used to separate the passenger region of a train loading platform from an adjacent set of train tracks to prevent passengers from accessing the tracks prior to a train reaching the platform. Such systems generally utilize a sliding gate operable between a closed position, to prevent access to the track or train region, and an open position, to permit access to the train when the train arrives at the platform. Such platform screen gates systems vary in design; however, many gate systems require complex designs, include multiple moving parts and are expensive to manufacture.

SUMMARY

In a first aspect, there is provided a platform screen gate system having a tower, a gate secured to the tower. The gate is movable between an open position, to facilitate access to and from the platform, and a closed position, to block access to and from the platform. The system further includes at least one roller secured to the tower and a track secured to the gate. The track is supported by and movable on the least one roller such that the door cantilevers from the tower and remains above the platform when the door is moved between the open and closed positions.

According to some embodiments, the tower includes a second roller, wherein the track is supported by and cantilevers from the first and second rollers.

In other embodiments, the tower includes an upper portion and a lower portion, the at least one roller is secured to the upper portion.

In still other embodiments, the gate includes a belt extending from a first end of the gate to a second end of the gate.

In yet other embodiments, a motor is disposed in a lower portion of the tower, the motor being movable on a slide track to adjust belt tension.

In other embodiments, the tower includes a pulley system to apply a tension and rotational force to the belt, the pulley system is disposed in the lower portion of the tower.

In yet another embodiments, the gate includes a lower gate panel adjacent to the belt to at least partially cover the belt.

In still other embodiments, the gate includes an opening positioned to facilitate access to one or more of a motor, a pulley system, toggle switches, and a power supply when the gate is in the closed position.

In other embodiments, the track is located at an upper portion of the gate.

In yet another embodiment, the gate includes a support member on the lower portion of the gate and slideably disposed within a slot in a threshold located beneath the gate.

In a second aspect, there is provided a platform screen gate system having a tower having an upper portion and a lower portion and a gate slideably connected to and cantilevered from the tower by at least one roller disposed in the upper portion of the tower. The system also includes an operator operably coupled to the gate and located in the lower portion of the tower for positioning the gate between an open position, to facilitate access to and from the platform, and a closed position, to block access to and from the platform.

In some embodiments, the gate is secured to the tower such that the gate is elevated above a platform surface upon which the tower is located.

In other embodiments, the tower includes a first tower section, a second tower section and an opening between the first tower section and the second tower section, wherein the gate is slideable within the opening between a closed position and an open position.

In still other embodiments, the second tower section includes the operator and is shorter than the first tower section.

In certain embodiments, the at least one roller is rotatably coupled to the first tower section.

According to a third aspect, there is provided a movable gate apparatus having a tower including a gate support and a controller. A gate is secured to the tower by the gate support and is slideably movable between an open position and a closed position in response to actuation by the controller. The gate includes an opening therethrough and positioned thereon such that when the gate is in the closed position, the opening is aligned with at least a portion of the controller to facilitate access thereto.

In certain embodiments, the gate support movably supports the gate in an elevated position above a platform surface upon which the tower is located.

In other certain embodiments, the gate support includes one or more of a roller, a track, a slide block and a slide blade.

In yet other embodiments, the tower includes a motor located in a lower portion of the tower and being accessible through the opening.

In still other embodiments, the gate includes a belt in a lower portion of the gate and the tower includes a pulley system in a lower portion of the tower to apply a force to the belt.

DESCRIPTION OF THE FIGURES

The accompanying drawings facilitate an understanding of the various embodiments.

DETAILED DESCRIPTION

Figure 3:
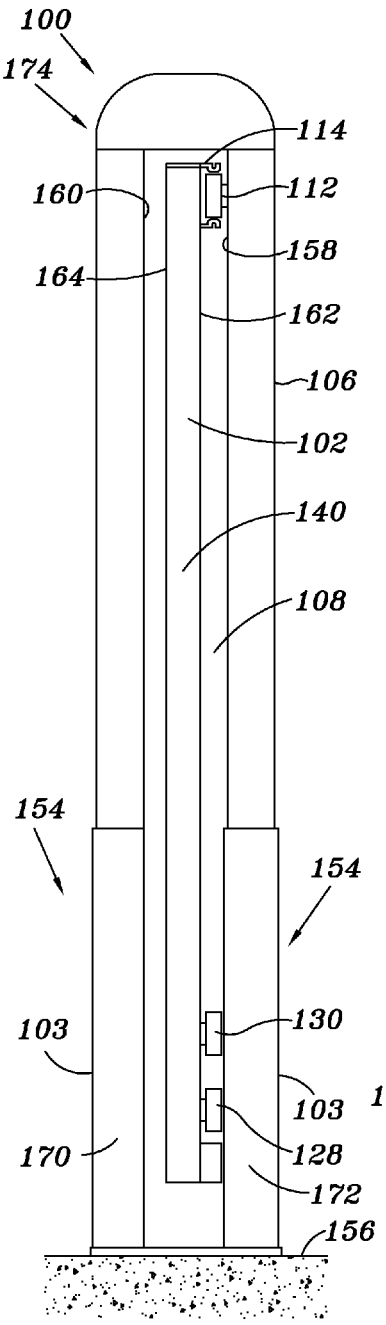
FIG. 3 is a right side view of the platform screen gate system of FIG. 1.
Figure 4:
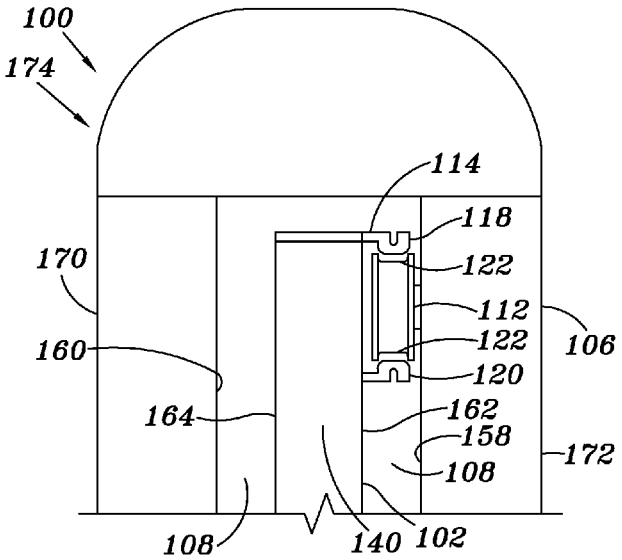
FIG. 4 is a close up view of a portion of the platform screen gate system of FIG. 3.
Figure 5:
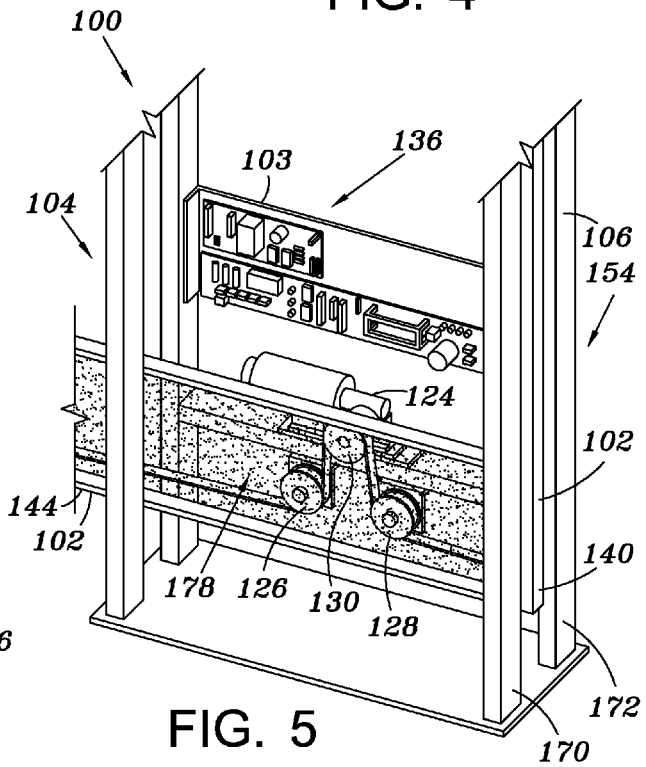
FIG. 5 is a close up view of a tower and a gate of a platform screen gate system in accordance with this disclosure.
Figure 6:
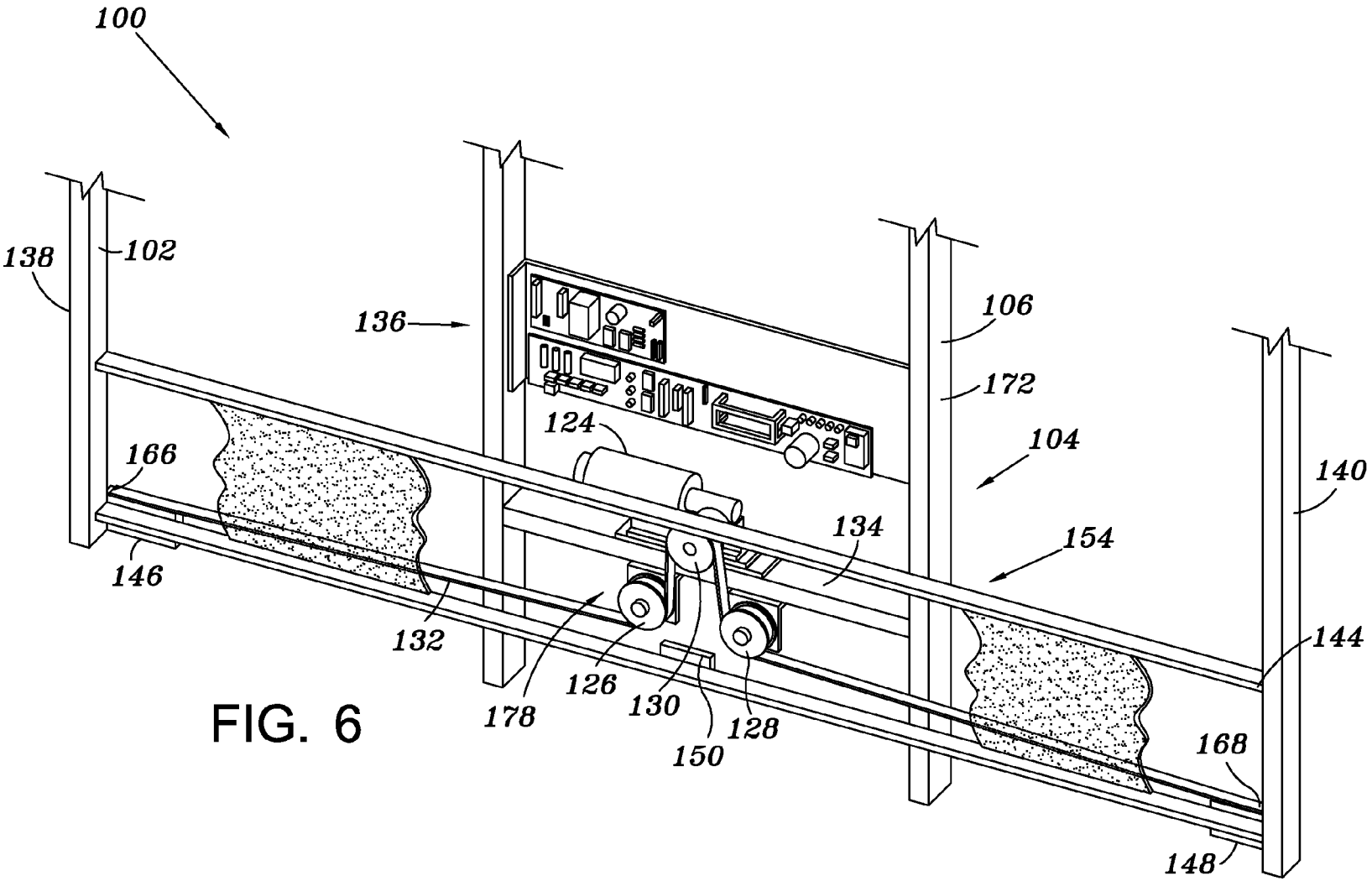
FIG. 6 is another close up view of a tower and a gate of a platform screen gate system in accordance with this disclosure.

Referring to FIGS. 1-8, a platform screen gate 100 is illustrated that includes an operator 104 (FIGS. 5 and 6)

located in a base portion 154 of a tower 106 for moving a door or gate 102 between an open position, to faciliate access to and from a platform, and a closed position, to block access to and from a platform. As described in more detail below, the tower 106 is sized and otherwise positioned to house the operator 104 generally adjacent to the gate 102 rather than above the gate 102. By locating the operator 104 in the base portion 154 of the tower 106, the platform screen gate 100 is usable in applications where the overall height of the platform screen gate 100 is restricted or increased heights are not desired, such as, for example, to preserve an open air view above the platform screen gate 100. In addition, the door 102 of the platform screen gate 100 is supported in a cantilever fashion from the tower 106 to minimize time and cost for installation of the platform screen gate 100 and so that the platform screen gate 100 can be installed on existing or new platforms with minimal or no excavation of a portion of the platform under the opening to which access is to be restricted, as will be described in more detail below.

Figure 1:
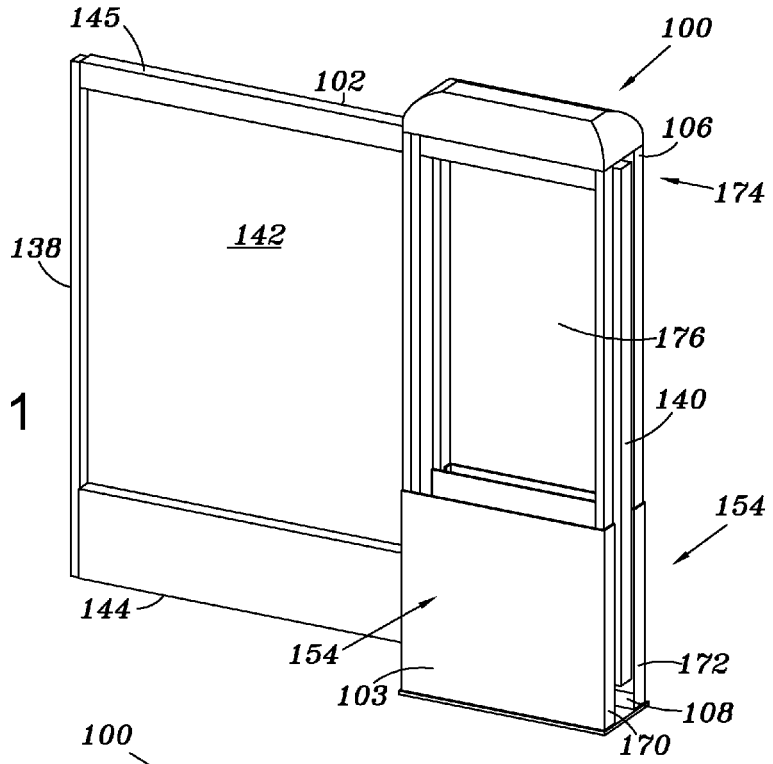
FIG. 1 is a perspective view of a platform screen gate system in accordance with this disclosure.
Figure 2:
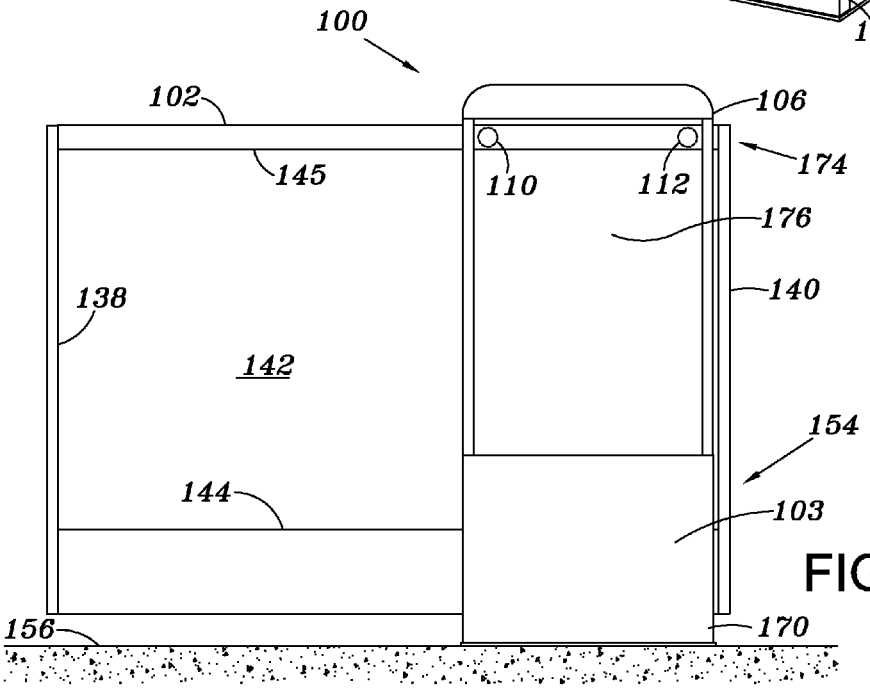
FIG. 2 is a front view of the platform screen gate system of FIG. 1.

In the embodiment illustrated in FIGS. 1-6, the tower 106 is configured to support the weight of the gate 102 and maintain the gate 102 in an upright position when the gate 102 is installed on a horizontal platform floor 156 (shown in FIGS. 2 and 3). In general, the platform screen gate 100 includes a tower 106 formed of a first tower section 170 that is spaced apart from a second tower section 172 to form an opening 108 therebetween to receive the gate 102. The first tower section 170 and the second tower section 172 each include a base portion 154, each of which being operable to house at least part of the operator 104 (shown in FIGS. 5 and 6) and each including lower tower panel 103 to obscure the operator 104 from view by passengers on the platform. For example, in the embodiment illustrated in FIGS. 5 and 6, the operator 104 includes a motor 124 and controller 136 and is supported in the base portion 154 of the second tower section 172 adjacent to the lower tower panel 103 of the second tower section 172; although it should be understood that the operator 104 is otherwise positioned in other embodiments (i.e., positioned within the first tower section 170 and/or at least a portion in the first tower section 170 and at least a portion in the second tower section 172). The tower 106 further includes a top portion 174 to house first and second rollers 110 and 112 (shown in FIG. 2) and/or other mechanism to movably support the gate 102 in a cantilever fashion, as will be described in more detail below. In some embodiments, the first tower section 170 and the second tower section 172 each include a translucent or transparent tower panel 176 located above the lower tower panel 103.

In the embodiment illustrated in FIGS. 1-6, the first and second tower sections 170 and 172 are similar in height. In other embodiments, the first and second towers 170 and 172 are of differing heights. For example, in the embodiment illustrated in FIG. 7, the first tower section 170 is taller than the second tower section 172. In particular, the first tower section 170 is slightly taller than the gate 102 and includes rollers 110 and 112 to support the gate 102, as will be described in more detail below. The second tower section 172 is sized to enclose the operator 104 and includes a shield 105 to protect the operator 104.

Referring again to the embodiment illustrated in FIG. 2, the gate 102 includes a first post 138 and a second post 140 that are connected by an upper gate panel 145 and a lower gate panel 144. The gate 102 is sized to fit within the opening 108 (FIG. 3) in the tower 106 and may be any suitable length to correspond to an opening to which access is to be restricted. The platform screen gate 100 may completely or partially block the opening to which access is to be restricted. In some embodiments, for example, the gate 102 blocks a first half of the opening to which access is to be restricted and a gate 102 of a second platform screen gate (not shown) blocks a second half of the opening. The first post 138, the second post 140, the upper gate panel 145 and the lower gate panel 144 may be made of any suitable material, such as, for example, metal or extruded aluminum, and a main panel 142 located between the first post 138, the second post 140, the upper gate panel 145 and the lower gate panel 144 may be made of the same material or a different material. In some embodiments, for example, the main panel 142 is made of a translucent glass material. In other embodiments, the gate 102 may be other suitable shapes and configurations to selectively block an opening to which access is to be restricted and the gate 102 need not include the specific configuration of a first post 138, a second post 140, an upper gate panel 145, a lower gate panel 144 and a main panel 142.

In the embodiment illustrated in FIG. 2, the gate 102 is held and/or otherwise supported a predetermined distance above a platform floor 156 by first and second rollers 110 and 112 on the tower 106. When the gate 102 is in the closed position, as shown in FIG. 2, the first post 138 of the gate 102 is suspended above the platform floor 156 and the second post 140 of the gate 100 is located adjacent to the tower 106. When the gate 102 is in the open position (not shown), the first post 138 is located adjacent to the tower 106 and the second post 140 is suspended above the platform floor 156. Thus, the tower 106 is configured to allow passage of the gate 102 from the closed position to the open position through the opening 108 while holding the gate 102 at a predetermined distance above the platform floor 156. The first and second rollers 110 and 112 support the gate 102 in the cantilever fashion such that the gate 102 extends away from the tower 106 unsupported at an end of the gate 102 furthest from the tower 106, as will be described in more detail below.

Referring specifically to FIGS. 3 and 4, the gate 102 is supported on the first and second rollers 110 and 112 of the tower 106 by a track 114 secured to the gate 102. The track 114 is sized to receive the first and second rollers 110 and 112 and is coupled to a first side surface 162 of the gate 102. Referring now specifically to FIG. 4, the track 114 includes a first track portion 118 spaced apart from a second track portion 120 by a distance that is slightly larger than the diameter of the rollers 110 and 112. In other embodiments, the first and second track portions 118 and 120 may be otherwise disposed. In some embodiments, the first track portion 118 and the second track portion 120 are convex in shape to correspond to a concave surface 122 of the first and second rollers 110 and 112. Contact between the first track portion 118, the second track portion 120 and the concave surfaces 122 of the first and second rollers 110 and 112 maintains the first and second rollers 110 and 112 centered with respect to the first track portion 118 and the second track portion 120. While first and second rollers 110 and 112 are illustrated in the embodiments of FIGS. 3 and 4, the tower 106 may include any number of rollers. For example, in some embodiments the tower 106 includes four rollers.

While the embodiments of FIGS. 3 and 4 depict a first roller 110 and a second roller 112 disposed on the first side surface 158 of the opening 108, in some embodiments the tower 106 also includes rollers (not shown) disposed on a second side surface 160 of the opening 108. In some embodiments, the rollers (not shown) disposed on the second side surface 160 align with the first roller 110 and the second roller 112 disposed on the first side surface 158. In some embodiments, the gate 102 includes a second track (not shown) on a second side surface 164 of the gate 102 to couple to the rollers disposed on the second side surface 160 of the opening 108. In some embodiments, such as the embodiment illustrated in FIG. 7, the first tower section 170 includes an arm 171 that extends over the gate 102 and includes rollers 110 and 112 to support the gate 102.

Any number of rollers 110 and 112 can be included on the tower 106 to support the gate 102 and any number of corresponding tracks 118 and 120 can be included on the gate 102 to accept the rollers 110 and 112. In some embodiments, additional rollers (not shown) are included to ride along a bottom portion of the lower track 120 for the purpose of preventing derailment. The vertical position of the rollers 110 and 112 can be adjustable to accommodate field conditions requiring adjustment (i.e., to tilt the door up or down). In addition, in some embodiments, the rollers 110 and 112 are located on the gate 102 and the tracks 118 and 120 are located on the tower 106. In some embodiments, the rollers 110 and 112 are located on a passenger-facing side of the tower 106 while in other embodiments the rollers 110 and 112 are located on a train-facing side of the tower 106. In other embodiments, the rollers 110 and 112 and the tracks 118 and 120 are positioned at locations other than the top of the gate 102 and the top of the tower 106. For example, in some embodiments, the rollers 110 and 112 and the tracks 118 and 120 are located near a bottom of the gate 102 and the tower 106 to hold the gate 102 in a cantilever fashion. In other embodiments, the rollers 110 and 112 and the tracks 118 and 120 are located near the middle of the gate 102 and the tower 106 to hold the gate 102 in a cantilever fashion.

In some embodiments, other mechanisms are utilized to allow the gate 102 to move with respect to the tower 106 and to hold the gate 102 in a cantilever fashion. For example, in some embodiments the tower 106 includes one or more slide blocks (not shown) that are slideably coupled to corresponding blades (not shown) on the gate 102. In other embodiments, both the gate 102 and the tower 106 include tracks and a plurality of bearings are positioned between the tracks 118 and 120 to allow the gate 102 to move with respect to the tower 106.

Referring to FIGS. 5 and 6, the tower 106 includes an operator 104 located in the base portion 154 of the tower 106; however, it should be understood that operator 104 may be otherwise positioned on the tower 106 (i.e., on an upper portion) or even adjacent the tower 106. For illustration purposes, the lower tower panel 103 is not shown in the first tower section 170 in FIG. 5 or in the first and second tower sections 170 and 172 of FIG. 6 to clearly show the operator 104. In the embodiment illustrated in FIG. 6, the operator 104 includes a motor 124, a slide track 134 to movably support the motor 124, a controller 136, a pulley system 178 and a belt 132. In other embodiments, the operator 104 also includes toggle switches (not shown) and a power supply (not shown). The motor 124 is positioned in a horizontal orientation and is movably coupled to a slide track 134 to allow the motor 124, as well as a tension pulley 130 that is coupled to the motor 124, to move within the tower 106. The tension pulley 130 is movable on the slide track 134 to apply a desired amount of tension to the belt 132. Once the desired amount of tension is applied to the belt 132, the motor 124 and the tension pulley 130 are secured in place on the slide track 134 to maintain the tension in the belt 132. The motor 124 and tension pulley 130 are also movable to allow for maintenance of the pulley system 178, belt 132 or other components of the platform screen gate 100, or to re-adjust the amount of tension in the belt 132.

The controller 136 controls the movement of the gate 102 by controlling the motor 124 in a conventional fashion. The controller 136 may be any suitable controller 136.

The pulley system 178 includes a first idler pulley 126, a second idler pulley 128 and the tension pulley 130. The first idler pulley 126 and the second idler pulley 128 are spaced from the tension pulley 130 by a predetermined vertical distance. The idler pulleys 126 and 128 are maintained in a fixed position and the tension pulley 130 is movable along the slide track 134 to apply tension to the belt 132, as described above.

The belt 132 is connected to the gate 102 and interacts with the pulley system 178 such that movement of the tension pulley 130 via the motor 124 causes the gate 102 to move between the open position and the closed position. A first end 166 of the belt 132 connects to the gate 102 at a first block 146 and a second end 168 of the belt 132 connects to the gate 102 at a second block 148. In some embodiments, the belt 132 includes surface contours, openings or some other feature to allow the tension pulley 130 to impart a force to the belt 132. In some embodiments, for example, the belt 132 includes linked segments of material, such as links in a metal chain, and the tension pulley 130 includes teeth that mate with the segments. In use, the motor 124 applies a force to the tension pulley 130 when the motor 124 is engaged by the operator 136. The tension pulley 130 applies a force to the belt 132 and the belt 132 moves in a lateral direction which causes the gate 102 to move within the opening 108 in the tower 106. The gate 102 is supported in a cantilever fashion by the rollers 110 and 112 so that an end of the gate 102 furthest from the tower 106 is held a predetermined distance above the platform floor 156.

In some additional embodiments, the gate 102 includes one or more additional rollers (not shown) positioned below and coupled to the lower gate panel 144 to support the gate 102 on the platform floor 156 or on a threshold (not shown) positioned on the platform floor 156. In some embodiments, the threshold is positioned on the platform floor 156 below the opening to which access is to be restricted and at least a portion of the additional roller(s) rolls inside, parallel to or next to a groove in the threshold to support the gate 102 as the gate 102 moves between the open and closed positions. In some embodiments, the threshold is installed on top of the platform floor 156 and requires minimal or no excavation of the platform floor 156 due to available space between the gate 102 and the platform floor 156. In other embodiments, the system 100 includes one roller 110 or 112 in the tower 106 and one additional roller (not shown) below the lower gate panel 144 that rolls on a threshold (not shown) on the platform floor 156. In other embodiments, the gate 102 includes a blade below the lower gate panel 144 that slides in a groove in a threshold (not shown) located below the gate 102 to provide lateral stability to the gate 102 as the gate 102 moves between the open and closed positions.

Figure 8:
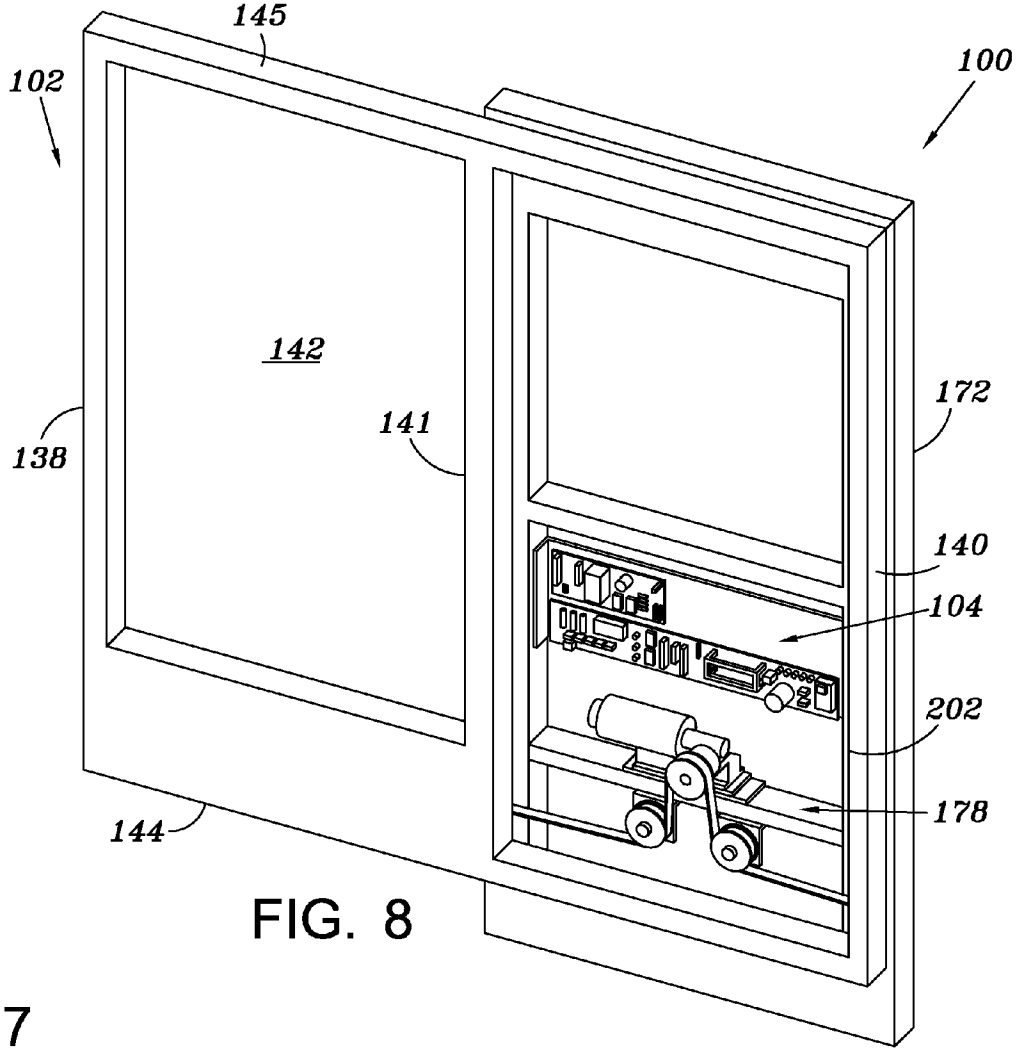
FIG. 8 is a perspective view of another embodiment of a platform screen gate system in accordance with this disclosure.
Figure 7:
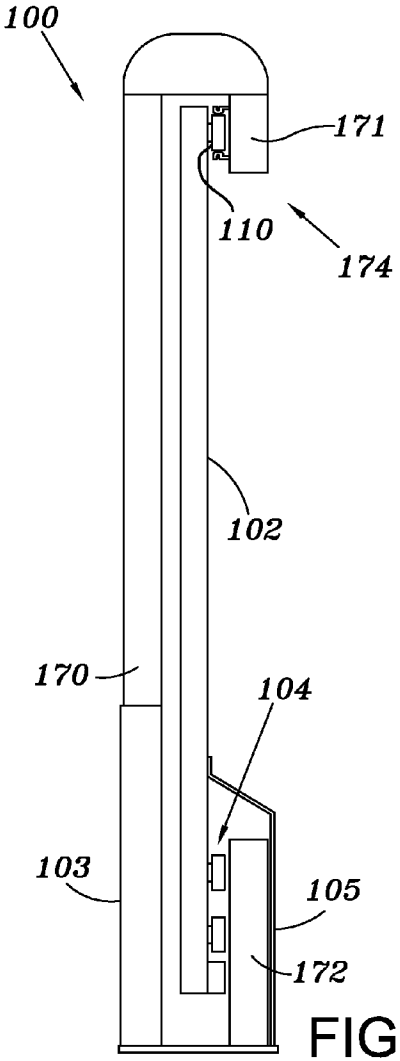
FIG. 7 is a side view of another embodiment of a platform screen gate system in accordance with this disclosure.

FIG. 8 is a perspective view of another embodiment of a platform screen gate 100 that includes a gate 102 with an opening 202 located between the second post 140 and a third post 141 of the gate 102. In some embodiments, the opening 202 provides access to the operator 104 and the pulley system 178 when the gate 102 is in the closed position, as shown in FIG. 8. In some embodiments, the opening 202 provides access to one or more of the motor 124, the pulley system 178, toggle switches (not shown), and a power supply (not shown). The first gate section 170 is not shown in FIG. 8 to more clearly show the opening 202.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A platform screen gate system, comprising:

a tower;

a gate secured to the tower, the gate movable along a pathway between an open position, to facilitate access to and from a platform, and a closed position, to block access to and from the platform;

at least one roller secured to the tower;

a track secured to the gate, the track supported by and movable on the at least one roller such that the gate cantilevers from the at least one roller and remains above the platform when the door is moved between the open and closed positions, wherein the track comprises an upper track portion and a lower track portion, and wherein the at least one roller is located between the upper track portion and the lower track portion;

a slide track secured to the tower, the slide track having a longitudinal axis that is parallel to the pathway; and a motor coupled to the slide track, the motor further coupled to a tension pulley and being operable to drive a belt secured to the gate and to position the gate along the pathway between the open and closed positions, wherein moving both the motor and the tension pulley linearly along the longitudinal axis of the slide track adjust tension in the belt.

2. The platform screen gate system of claim 1, wherein the tower includes a second roller, wherein the track is supported by and cantilevers from the first and second rollers.

3. The platform screen gate system of claim 1, wherein the tower includes an upper portion and a lower portion, the at least one roller is secured to the upper portion.

4. The platform screen gate system of claim 1, wherein the belt extends from a first end of the gate to a second end of the gate.

5. The platform screen gate system of claim 4, wherein the motor is disposed in a lower portion of the tower.

6. The platform screen gate system of claim 5, wherein the tower includes a pulley system to apply tension and rotational force to the belt, wherein the pulley system including the tension pulley is disposed in the lower portion of the tower.

7. The platform screen gate system of claim 4, wherein the gate includes a lower gate panel adjacent to the belt to at least partially cover the belt.

8. The platform screen gate system of claim 1, wherein the gate comprises an opening positioned to facilitate access to one or more of the motor, a pulley system including the tension pulley, toggle switches, and a power supply when the gate is in the closed position.

9. The platform screen gate system of claim 1, wherein the track is located at an upper portion of the gate.

10. A platform screen gate system, comprising:

a tower having an upper portion, a lower portion and a slide track;

a gate slideably connected to and cantilevered from the tower by at least one roller disposed in the upper portion of the tower, wherein the gate comprises an upper track portion and a lower track portion and the at least one roller is located between the upper track portion and the lower track portion;

a belt coupled to the gate, the belt movable to position the gate along a pathway between an open position, to facilitate access to and from a platform, and a closed position, to block access to and from the platform, wherein the pathway extends through the tower such that at least part of the gate is movable along the pathway through the tower, wherein a longitudinal axis of the slide track is parallel to the pathway; and an operator operably coupled to the gate and located in the lower portion of the tower for positioning the gate between an open position, to facilitate access to and from a platform, and a closed position, to block access to and from the platform, wherein the operator comprises a motor coupled to a tension pulley that is operably coupled to the belt which moves the gate between the open position and the closed position;

wherein the motor is disposed on and linearly movable along the longitudinal axis of the slide track and movement of the motor and the tension pulley along the longitudinal axis adjusts tension in the belt, wherein the motor is securable in a desired position on the slide track when a desired tension is achieved in the belt.

11. The platform screen gate system of claim 10, wherein the gate is secured to the tower such that the gate is elevated above a platform surface upon which the tower is located.

12. The platform screen gate system of claim 10, wherein the tower comprises a first tower section and a second tower section and wherein an opening is located between the first tower section and the second tower section to receive the gate therethrough.

13. The platform screen gate system of claim 12, wherein the second tower section includes the operator and is shorter than the first tower section.

14. The platform screen gate system of claim 13, wherein the at least one roller is rotatably coupled to the first tower section.

15. The platform screen gate system of claim 10, wherein the gate is movable along a plane between an open position and a closed position, wherein the at least one roller has an axis of rotation that is perpendicular to the plane.

16. A movable gate apparatus, comprising:

a tower including a gate support in an upper portion of the tower and a controller in a lower portion of the tower, wherein the controller includes a motor; and a gate secured to the tower by the gate support and slideably movable between an open position, to facilitate access to a platform, and a closed position, to block access to the platform, along a pathway in response to actuation by the controller, wherein the pathway is at least partially located between the first tower section and the second tower section, a bottom of the gate is below the motor and a top of the gate is above the motor when the gate is in the fully closed position, the gate having an opening therethrough and positioned thereon such that when the gate is in the fully closed position, the opening is aligned with the motor to facilitate access thereto, and wherein when the gate is in the fully open position, the opening is misaligned with the motor and the gate obscures access to the motor.

17. The movable gate apparatus of claim 16, wherein the gate support movably supports the gate in an elevated position above a platform surface upon which the tower is located.

18. The movable gate apparatus of claim 16, wherein gate support comprises one or more of a roller, a track, a slide block and a slide blade.

19. The movable gate apparatus of claim 16, wherein the gate includes a belt in a lower portion of the gate and the tower includes a pulley system in a lower portion of the tower to apply a force to the belt.

20. The movable gate apparatus of claim 16, wherein the gate includes a belt that is operably engaged with the motor, wherein the motor is movable on a slide track that is parallel to the pathway to adjust tension in the belt.

21. A platform screen gate system, comprising:

a tower including a motor; and a gate secured to the tower, the gate movable along a first pathway between an open position, to facilitate access to and from a platform, and a closed position, to block access to and from the platform, wherein a belt is secured to the gate;

wherein the tower comprises a slide track having a longitudinal axis that is parallel to the first pathway, wherein the slide track is fixed to the tower;

wherein the motor is coupled to a tension pulley and is secured to and linearly movable along the longitudinal axis of the slide track, wherein movement of the motor and the tension pulley along the longitudinal axis of the slide track adjust tension in the belt, wherein the motor is securable in a desired position on the slide track when a desired tension is achieved in the belt.

22. The platform screen gate system of claim 21, wherein the gate comprises an opening therethrough and positioned thereon such that when the gate is in the closed position, the opening is aligned with the motor.

* * * * *